US005377922A

United States Patent [19]

Fredriksson et al.

[11] Patent Number: 5,377,922

[45] Date of Patent: Jan. 3, 1995

[54] SENSING AND/OR ANALYSIS SYSTEM FOR THREAD FEEDER

[75] Inventors: Lars-Berno Fredriksson, Kinna; Joachim Fritzson, Ulricehamn, both of Sweden

[73] Assignee: IRO AB, Ulricehamn, Sweden

[21] Appl. No.: 969,182

[22] PCT Filed: Jun. 6, 1990

[86] PCT No.: PCT/SE91/00406

§ 371 Date: Feb. 2, 1993

§ 102(e) Date: Feb. 2, 1993

[87] PCT Pub. No.: WO91/18818

PCT Pub. Date: Dec. 12, 1991

[30] Foreign Application Priority Data

Jun. 6, 1990 [SE] Sweden ..... 9002031-4

[51] Int. Cl.[6] ..... B65H 51/20

[52] U.S. Cl. ..... 242/47.01

[58] Field of Search ..... 242/47.01, 47.04, 47.05, 242/47.06, 47.07, 47.08, 47.09, 47.1, 47.11, 47.12, 47.13; 66/132 R, 132 T; 139/452

[56] References Cited

U.S. PATENT DOCUMENTS

| | | | |
|---|---|---|---|
| 3,720,384 | 3/1973 | Rosen | 242/47.01 |
| 4,161,297 | 7/1979 | Vella | 242/47.01 |
| 4,180,215 | 12/1979 | Nurk | 242/47.01 |
| 4,653,701 | 3/1987 | Riva | 242/47.01 |
| 4,676,442 | 6/1987 | Tholander et al. | 242/47.01 |
| 4,687,149 | 8/1987 | Riva | 242/47.01 |
| 4,715,411 | 12/1987 | Van Bogaert et al. | 242/47.01 X |
| 4,865,085 | 9/1989 | Ghiardo | 242/47.01 X |
| 5,119,998 | 6/1992 | Tholander et al. | 242/47.01 |

FOREIGN PATENT DOCUMENTS

| | | |
|---|---|---|
| 0192851 | 9/1986 | European Pat. Off. . |
| 0332164 | 9/1989 | European Pat. Off. . |
| 2609973 | 9/1976 | Germany . |

*Primary Examiner*—Stanley N. Gilreath

*Attorney, Agent, or Firm*—Flynn, Thiel, Boutell & Tanis

[57] ABSTRACT

In a sensing and analyzing system for a yarn feeder with yarn storing unit, one or more sensor elements which may be coupled to one or more circuits are used for evaluating or sensing sensor information. At least one sensor element is placed in the unit, from a yarn detection standpoint, in an uncritical relationship to the unit's yarn transporting surface and a yarn turn travelling forward on this. The transmitting members are designed to relay information from each sensor element in the unit in unprocessed or processed form to receiving members located outside the unit. Energy emitting members within the unit ensure energy supply to the sensor elements and the circuits belong thereto. When using optical emitting elements, these are included in an arrangement which supplements or alternatively substantially reduces the influence of vibrations in the unit on the sensing or analyzing result.

26 Claims, 10 Drawing Sheets

SENSING AND/OR ANALYSIS SYSTEM FOR THREAD FEEDER

FIELD OF THE INVENTION

The present invention relates to a device on a sensing and/or analyzing system for a yarn feeder with yarn storing unit (spool body) in which the system is designed to initiate information attributable to one or more of the functions: detection of the presence or absence of yarn turns on the unit, detection of the maximum or minimum number of yarn turns on the unit, analysis or sensing of the yarn, for example of its diameter, colour, etc., and/or analysis or sensing of the yarn store's behaviour/changes during operation, etc. The system is therefore of the type which comprises one or more sensor elements and, where necessary, one or more members, preferably electrical circuits, for processing, evaluating and/or initiating, etc. information from the said sensor elements. Also included are power supply members for each sensor element and member (circuit).

BACKGROUND OF THE INVENTION

Analyzing and sensing systems for yarn feeders are known in the art. Also known is the use of radiation emitting and radiation receiving members for establishing the presence of yarn on the spool body in a yarn feeder. In these, use is made of evaluating circuits for determining the presence of yarn stores located on the spool body and regulating the number of turns of the yarn feeder as a function of the evaluation. Reference may be made here, inter alia, to European Published Patent Application EP 192 851 and German Published Specification 2 609 973.

A general demand exists with yarn feeders to effect a reliable sensing and analyzing function. Among other things, the problem depends on whether or not the yarn store supporting unit or body is subject to vibration. With a body subject to vibration the aim here is to ensure that the unit is arranged in the yarn feeder in such a way that when the yarn feeder is in operation, the unit can vibrate or oscillate owing to mechanical phenomena and oscillations. The function of the sensing and analysing system must also take account of tolerances which exist in the component parts of the yarn feeder and its assembly, and there are problems in making the sensing and analyzing systems independent of any variation parts of the yarn feeder. In some designs there is a demand for using relatively large tolerances between the assembly positions of the various parts of the yarn feeder. Another demand is for the facility for assembling the parts included in the sensing and analyzing system in a modular arrangement. This gives rise to problems in establishing radiation paths inside the modular arrangement which give small overall heights.

If an imaging system, for example, is used for sensing and/or analysis, there is a limited area in which a sufficiently sharp image required for the initiation is obtained. In the case where a radiation source outside the unit/body is used for emitting the beam from outside against the yarn, there are the problems of effective indication in connection with the yarn feeder.

Demands may arise with the sensing and analysing function for the use of a contact image function, imaging function with object lens or shadow image sensing. Various possibilities exist with regard to this and examples include the use of refracting optics in the unit/body, mirror optics in the unit/body, optics outside the unit/body or a function in which the yarn is used as the dispersing/reflecting element in the identification function.

If refracting optics are used, for example, in the unit, there is a decided problem in getting away from the effect of oscillations in the unit. The same goes for mirror optics in the unit/spool body. With optics outside the spool body there are problems with obtaining a sufficiently good focus from the optics without making the mechanical tolerances too stringent.

The yarn feeder must be capable of working with various types of yarn and yarn diameters. When detecting fine yarns it should be possible to use imaging optics in order to obtain small measuring points, for example measuring points in the order of $30\text{–}100\times10^{-5}$ m (30–100 $\mu$m).

In certain cases, there are great demands that the sensing and analyzing system should be largely insensitive to dust and other airborne particles. From this there stems the demand in some cases to be able to use the actual yarn in the cleaning function, i.e. as the yarn turns pass over the yarn store supporting surface of the spool body, the yarn must be capable of keeping this free of dust so that this does not stick and spoil the result.

In connection with this, problems may arise in arranging an effective indication function in close connection with the yarn store supporting surface. It should be possible to arrange the illuminating and receiving members uncritically in connection with the surface.

The energy supply and measuring results from the members handling the sensor elements must also be arranged reliably in the various existing assemblies.

The present invention proposes a device which solves all or some of the problems indicated above. What may be regarded, among other things, as the characteristic feature of the new device is that at least one sensor element is located in the unit/spool body in a, from a yarn detection standpoint, uncritical relationship to the unit's yarn transporting surface and the yarn turn travelling forward on this. In addition, transmitting members are designed to relay information by wireless means from each sensor element in the unit in unprocessed or processed form to the receiving members located outside the unit/spool body. The unit/spool body is energy self-sufficient and/or can be supplied with energy by wireless means and emits energy to each sensor element and the said wireless transmission by means of an energy emitting/energy converting member located in the unit, for example in the form of a battery, generator, inductive winding, capacitive member, etc. The characteristics may be supplemented or exchanged in cases where one or more of the sensor elements consists of an optical sensor element which together with one or more optical emitting elements forms part of an arrangement on a unit exposed to vibration. The arrangement in this case is designed to significantly reduce the effect of the unit's vibration on the sensing and/or analysis results.

In one embodiment, sensor elements arranged in the unit/spool body are placed in close connection with the unit's yarn transporting surface. Close connection here is taken to mean a distance equal to approximately one yarn diameter. The sensor elements are preferably placed in successive rows, they can possibly also occupy different positions in the direction of the angle of rotation. The information which is thereby obtained from the sensor element/sensor elements can be processed by means of circuits which are arranged in the unit and, for example, comprise a microprocessor which is connected to or comprises memory storage members. Measured value converting elements can also be included and are then preferably connected to the microprocessor. The sensor elements and their associated equipment are preferably arranged on an assembly board. This in turn can be arranged in a slot in the unit/-spool body. The sensor elements can thereby be placed on the board in such a way that they are positioned in connection with or on the actual board's edge. The board is thereby arranged essentially radially in the spool body, which means that the sensor elements are in close connection with, for example right on the yarn store supporting surface which can be homogeneous or formed from extended (for example finger-shaped) members regularly distributed along the arranged periphery or circumference.

In a preferred embodiment, one or more of the sensor elements operates with a capacitive function where each yarn storage turn brings about an indicatable modification. In this case each sensor element may comprise coverings/electrodes, one or more first electrodes of which are connected/connectable to a high frequency signal and one or more other coverings/electrodes have the function of an antenna/antennae. The sensor elements also comprise the modification on account of yarn passage sensing members which may be composed of a differential amplifier function which emits an indicating signal at each yarn turn passage.

In a further embodiment, one or more radiation emitting elements are used which are arranged in the spool body. The arrangement in this case works by radiation reflection against the yarn or the contrast effect against a background in which the yarn store, if so desired, can be formed by means of an object lens. In a further embodiment, one or more radiation emitting elements can be arranged outside the unit, for example in or on the yarn feeder's rail. The arrangement in this case functions by contact image sensing, imaging by means of an object lens or shadow image reproduction. The sensor elements can thereby be of a discrete and/or integrated type.

In a preferred embodiment, the sensor element is included in a component which is constructed separately and functions as a modular unit. In addition to each sensor element, the component comprises a limiting surface, fixed firmly in relation to the sensor element/sensor elements, via which optical radiation passes. the component is arranged or can be arranged in the unit/spool body so that the limiting surface is essentially, preferably precisely, connected to the unit's yarn supporting surface. The component may also comprise one or more radiation emitting elements (light emitting diodes, semiconductor laser, etc.). In the case in which the sensor elements and their associated signal evaluating equipment are placed in the unit, this is designed with wirelessly operating members by means of which it can transmit to receiving members outside the unit. Transmission may thus be by optical, inductive and/or capacitive means. The system can detect individual yarn stores, for example the first and last turns on the unit's yarn store. The system can function as a take-off sensor system and thereby uses information from each sensor element. Logic circuits connected to the sensor elements are thereby designed to draw conclusions from the sensor element information during the yarn's take-off process. The system can thereby be designed to take account of the cases in which the yarn feeder uses a yarn separation function in which the yarn store turns travel over the transporting surface with space between them. In one embodiment, sensor element tolerances critical for the detection of the yarn are built into this during manufacture of the sensor element and/or the parts comprising a sensor element.

The diameter and/or color of the yarn can be indicated with a view to predicting and drawing conclusions on the quality of the yarn, yarn breaks, color shade distribution, weak points, lumps, knots, etc.

In one embodiment, one or more sensor elements, the energy emitting/energy converting members and the transmitting members (transmitter and receiver) are arranged on a common board which can be fixed in the unit. The said energy emitting/energy converting members can be connected to a rectifier (not demanded in the case of a battery) which in turn is connected to a filter member. The transmitting members can operate with radiation, for example infra-red radiation. The transmitting members comprise receivers and transmitting units applied to the board which are tuned to corresponding receiving and transmitting members outside the unit. The latter members are arranged on the yarn feeder, for example in a rail belonging to the yarn feeder. The yarn feeder also comprises members for receiving sensor element information. The yarn feeder comprises circuits which can receive and where necessary process and further relay information to a superior control member for the yarn feeder and/or textile machine.

In one exemplary embodiment, a number of discrete radiation emitting elements are arranged outside the unit, for example in the rail of the yarn feeder. A sufficiently large part of the unit is to be illuminated with radiation emission in order to ensure that the problem with vibrations is solved; the spool body/unit can typically vibrate at approximately 20 Hz. In the cases where reading has to be done faster, provision is made for adequate illumination over the entire surface. A number of discrete sensor elements corresponding to the number of radiation elements is arranged in the unit. The sensor elements are preferably included in an assembly part which is arranged with a non-transparent surface largely coinciding with the units' yarn transporting surface, the non-transparent surface being provided with recesses/apertures/windows through which the radiation from each radiation emitting element can pass. A radiation emitting diode can be arranged outside the unit, for example in the rail of the yarn feeder. An integrated sensor element (array) can thereby be arranged so that it receives the radiation set up via an object lens and where necessary a mirror for deflecting the radiation path past the centre axis of the unit, a short integrated sensor element (for example with a length of approximately 25 mm) being able to be used to indicate a yarn store which exceeds the length of the sensor element by, for example, 2–3 times.

In a further embodiment, a radiation emitting element is arranged outside the unit, for example in the rail of the yarn feeder. An integrated sensor element (array) is connected to the unit's yarn transporting surface. On this surface the sensor element supports a fibre optic plate of a type known in the art. One or more of the said radiation emitting elements may be of the type which functions with monochrome light, for example semiconductor laser, IR diode with optical bandpass filter, etc.

Optimum solutions for the sensing and/or analyzing functions can be brought about by means of the measures suggested above. For example, by arranging sensor elements in close connection with the yarn transporting surface these can be positioned near to the yarn travelling forward. This provides the facility for arranging the yarn transporting surface so as to prevent the accumulation of dust. The arrangements can be arranged for feeding yarn with very small yarn diameters and insensitivity to vibrations in the unit/spool body. Purely capacitive solutions can be used, which is advantageous in the case of yarns which have the ability to influence the dielectric constant in the capacitive structure. The invention offers the facility for a wide liberty of choice when it comes to using optics with optical parts in and outside the spool body. Relatively speaking, technically simple and economically advantageous structures can be arranged, as well as more advanced and extremely accurately functioning arrangements.

By using translucent or transparent covering parts/-windows the detector arrangement can be protected as such. A fixed distance between the yarn and the detector can be built in with the said modular unit in an uncritical way (the limiting surface is placed on the yarn transporting surface). Small distance tolerances can be built into the modular unit which makes it possible to have small overall heights on the modular unit. Imaging optics can be used where a sharp image and hence a high resolution is obtained by the passage of the yarn (even with small yarn diameters, for example 30 μm). The indicating members can be arranged close to the yarn transporting surface (less than one yarn diameter). Placing the detector in the spool body provides the facility for structures which are largely insensitive to vibrations. Illumination (radiation emission) from the body/under the yarn transporting surface via translucent/transparent parts provides great insensitivity to dust and wear and tear. Illumination from below also provides considerable insensitivity to vibrations in the unit/spool body. Illumination from below also makes it possible to work with reflected light against the yarn. By placing the illumination outside the unit, insensitivity to vibrations is achieved by using a sufficiently broad and powerful radiation source. Placing the sensor in the spool body opens up quite generally the facility for working at a certain distance from the yarn. The sensor can be arranged in close connection with or in essential contact with the yarn. When using radiation/light guides these are preferably arranged directly against the yarn. If working at a distance from the yarn the yarn is imaged on the detector surface and it is not necessary to use any screen. The sensor senses only at a predetermined point. One method of achieving an appropriate solution to the problems formulated is to use imaging optics with an integrated measuring point. Another method is to use radiation guides which go up to the yarn with very close contact with the latter. Further advantages are obtained by also arranging the illumination in the unit. An array unit with, for example, 1024 detection points can be used. The entire yarn store can be imaged in a like manner. Each pixel can cover approximately 100 μm and the yarn storage length can be practically covered by approximately 0.1 meters.

BRIEF DESCRIPTION OF THE DRAWINGS

A currently proposed embodiment of a device exhibiting the features characteristic of the invention will be described below with reference to the drawings enclosed, in which.

DETAILED DESCRIPTION

Figure 1:
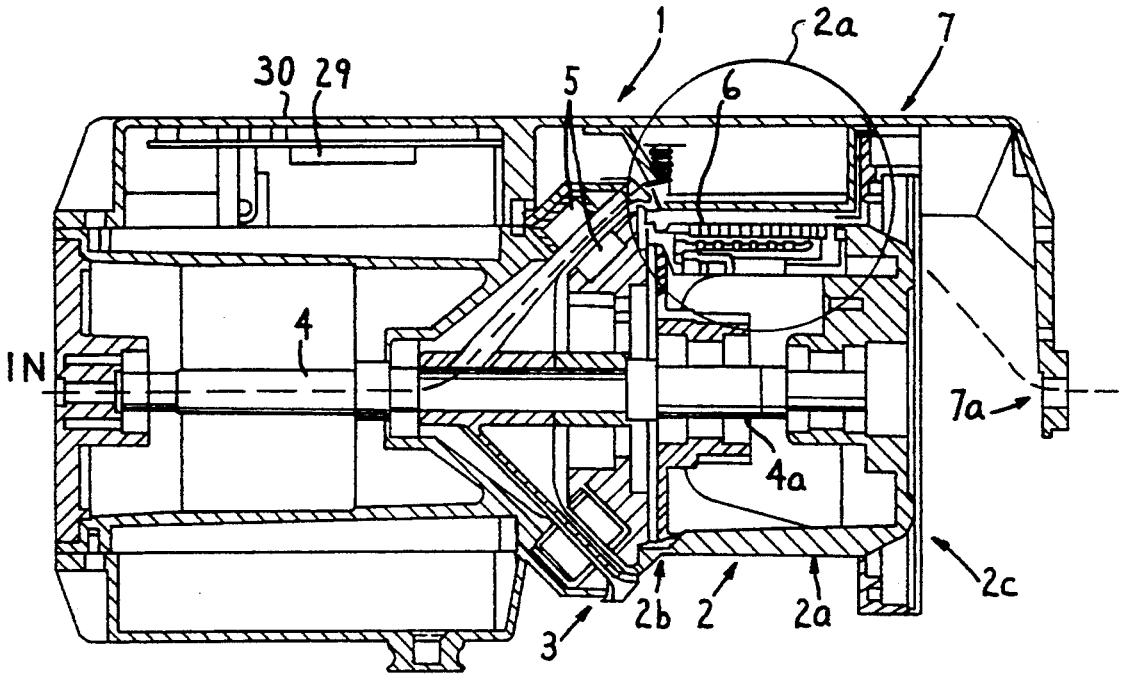
FIG. 1 shows in longitudinal section a constructive design for a yarn feeder, known in the art, which uses the new sensing and/or analyzing system.

FIG. 1 shows an exemplary embodiment of a yarn feeder 1 known in the art, which conventional yarn feeder incorporates the inventive sensing and/or analyzing system of the present invention. The yarn feeder has a yarn store supporting unit or spool body 2. The yarn feeder also comprises a winding member 3 which is arranged rotatably in the yarn feeder by means of an inner shaft 4. The spool body 2 is of the type which is fixed in its rotational position by means of magnets 5. A yarn (not shown in particular) is fed in via an intake aperture IN and fed into internal ducts in the shaft 4 and winding member 3 (see broken line). The yarn storage turns on the spool body 2 are symbolised by 6. The yarn feeder is also fitted with a rail 7.

The yarn is applied to the spool body's 2 yarn storage turn transporting surface 2*a* in a tangential direction on the rear end 2*b* of the spool body. The take-off takes place on the front end 2*c* of the spool body via an outlet eye 7*a* on the rail 7. The yarn path through the yarn feeder is thus decidedly "straight" and is characterised by the fact that the yarn path comprises only one relatively abrupt deflection, namely that on the passage between the winding member 3 and the rear end 2*b* of the spool body. This principle differs from the principle of the yarn feeder according to the German Published Specification 2609 973 which exhibits sharp deflections of the yarn path. A major and essential difference between the yarn feeder according to the German Published Specification and the present yarn feeder is that the first-mentioned yarn feeder has its yarn store supporting unit firmly joined to the motor housing, which is not the case with the present type of yarn feeder. The spool body 2 in the present yarn feeder is subject to vibration and may vibrate during operation. This propensity for vibrations is absent or is not as pronounced as in yarn feeders according to the German Published Specification. The vibrations make reliable functioning of the sensing and/or analysing system considerably more difficult. The system is intended to detect yarn breaks, to measure existing wound turns, measure existing thread stores and/or measure the number of turns wound off or parts thereof. It must be possible to sense the size of the yarn store quickly and accurately in order to facilitate good control of the yarn winding onto the storage spool. The sensor system is intended to sense the size of the yarn store with the greatest possible resolution. A modification in the yarn store should preferably be detected with a single turn's resolution. In a preferred embodiment the yarn break detection is integrated on the same board as the abovementioned sensor functions. The thickness of the thread may vary between 10 μm and several millimetres. The thread/yarn may be transparent, white, black, smooth or fluffy. The resolution of both coarse and fine yarn should be good. The thread speed may be up to approx. 100 m/sec. The yarn feeder may function either with or without yarn separation. If yarn separation is not used it must be possible to preset the length of the yarn store to different values so that the yarn store will consist of roughly the same number of turns for different yarns. The store is to be short for fine yarn, long for thick yarn, etc. If yarn separation is used there is no demand for presetting. Optical surfaces which come into contact with the yarn are exposed to wear and tear. The surfaces should therefore be selected so that they meet the wear demands. Where necessary, there should be reference signals for wear and tear. Certain yarns become very dusty which means that dust, dirt and colouring agents are deposited on all surfaces of the yarn feeder. The construction is therefore arranged with sufficient light intensity in order to function with dirty optics or so that the yarn itself keeps the optical surfaces clean. Where necessary there should be reference signals arranged which read off the dirt. Airborne dust particles or pieces of fluff should not cause incorrect signals. The system should be arranged to be largely insensitive to these. The sensing and/or analyzing system should be insensitive to scattered light. Methods of spectral filtering of the light by means of optical filters, or pulsing of the light source and electronic filtering may be used. In such cases a relatively fast detector is required which normally cannot be provided by a photo-transistor. Also preferable are systems which do not require absolute calibration. The spool body oscillates in rotating joints around the shaft. If a light reflex sensor is used against a plane mirror oscillation consequently occurs in the signal which can be 10 times stronger than the signal which is obtained by reflection from the thread (applies primarily to fine threads). This signal can be filtered out electronically in the event that the utility signal does not have as low a frequency as the oscillation (less than approx. 50 Hz). In certain exemplary embodiments the light level in the sensor may be relatively high in order to facilitate simplified electronics. In order to facilitate effective control of the yarn winding it should be possible to detect small modifications in the yarn store. It should preferably be possible to register one turn's modification in the store. Methods known hitherto are impaired by the weakness that they have difficulty in detecting fine threads, and one of the objects of the invention is to significantly improve such detection. In the present case the geometry of the optics is designed so that the assembly tolerances do not become too stringent in certain cases.

Different principles can be used in connection with the invention. Thus, for example, reflection can be used. The reflection is based on the principle of a light difference between yarn and background. Problems can occur if the yarn and the background are similar. The amplification is not made too great if there is any accessible background surface. Black yarns can be difficult to detect by this principle. Another principle is the transmission principle which is based on the fact that the yarn blocks or refracts light from the measuring point.

In this case the amplification can be made low since the transmitter shines straight into the receiver. Fine optical imaging is required in this case in order to detect a fine yarn, since a small measuring point is required. In this case the sensor is not so sensitive to airborne dust since the measuring point is small. Transparent yarns, however, may constitute a problem in this case.

A third principle is the so-called dispersion principle, which is based on the fact that the yarn scatters light into the receiver. A suitable background is empty space (with no scattered light), or a black shiny surface. In this case high amplification is possible since the background is black. Fine yarns can be well detected without the yarn being so well imaged by the optical system. In this case the sensor is relatively sensitive to airborne dust.

Since it is assumed that the yarn feeder shown in FIG. 1 and its principle are well known it will not be described in more detail here except to draw attention to the yarn feeder identified by the trademark "IRO-LASER" which is manufactured and sold on the general market by the Assignee of the present invention.

Figure 2B:
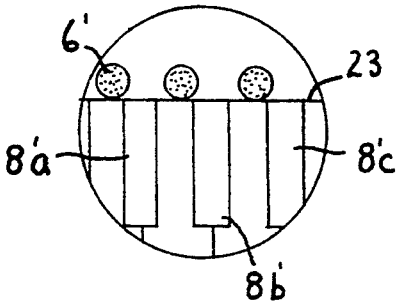
FIG. 2*b* shows an enlarged longitudinal section view of the area designated 2*b* in FIG. 2*a*.
Figure 2A:
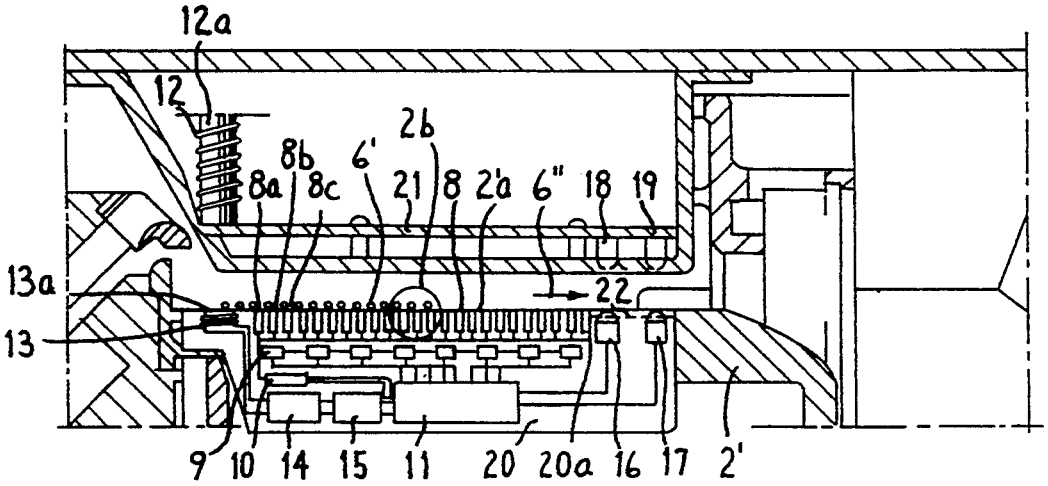
FIG. 2*a* shows an enlarged longitudinal section view of the area designated 2*a* in FIG. 1.
Figure 6:
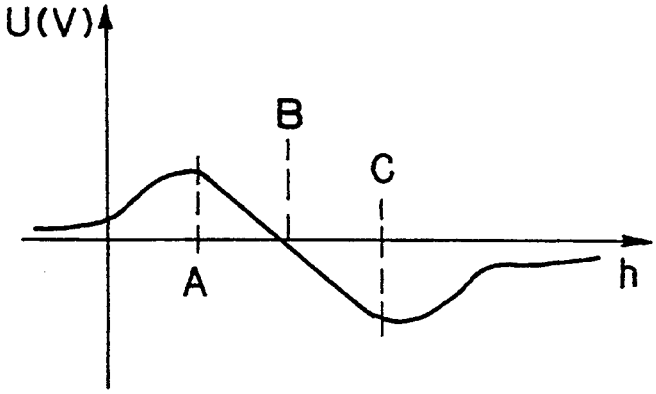
FIG. 6 shows in diagram form the design of an indicating signal which is obtained from the system according to FIG. 5.

In FIGS. 2*a* and 2*b* the sensing and/or analyzing system is shown enlarged in relation to FIG. 1. The embodiment shown works on the capacitive principle and comprises a number of coverings or electrodes 8. The embodiment has a number of sensor elements arranged one after another, which are mutually interconnected so as to produce relevant initiation of each passage of the yarn. The yarn turns 6' travel along the surface 2*a'* in the direction of the arrow 6''. Each yarn turn will therefore pass each sensor element. Each sensor element comprises three electrodes 8*a*, 8*b* and 8*c* which are connected to an assigned member 9 which is designed to emit a signal as a function of each yarn turn passage past the sensor element, as shown in FIG. 6. Two electrodes 8*a*, 8*c* of the said electrodes 8*a*, 8*b* and 8*c* are connected to a high frequency source or oscillator 10. The intermediate electrode 8*b* thereby acts as an antenna and is connected to the member 9. The oscillator 10 is connected to the outer electrodes in each sensor element and the members 9 in the sensor elements are also individually connected to a microprocessor 11. The oscillator 10 is also connected to the microprocessor or microprocessor control member 11. The sensor elements and the oscillator 10 and the microprocessor 11 are supplied with energy by means of an inductive coil, one winding 12 of which is arranged in the fixed part of the yarn feeder and the other winding 13 is arranged in the spool body 2'. The electrical energy transmitted from the winding 12 to the winding 13 is rectified in a rectifier 14 and the outgoing rectified voltage from the rectifier 14 is filtered in a filter 15 before the electrical energy is fed to the oscillator 10 and the microprocessor 11. The electrical energy can be obtained by alternative means in the unit 2'. An alternative method is to use a battery and another method is to use a generator function with the aid of the shaft 4 (see FIG. 1). The 4*a* part of the shaft extending in the unit/spool body 2' rotates in relation to the stationary unit. By arranging windings in the unit 2' and on the shaft, a generator function can be obtained which effects the energy supply to the oscillator 10 and the microprocessor 11 and other parts of the unit's equipment requiring energy. The microprocessor 11 also controls relay members for relaying the information obtained from the sensor elements and processed in the microprocessor 11. In the present case a transmitting member 16 and a receiving member 17 are used. These transmitting and receiving members are tuned to corresponding receiving members 18 and transmitting members 19 in the fixed parts of the yarn feeder outside the unit 2'. The transmitting and receiving members 16 and 17 in the present case work with infra-red radiation and can be of a construction known in the art. The communication between the transmitting and receiving members in the unit or in the part of the rail are wireless and in the present case also two-way. The sensor elements and their associated equipment in the unit are arranged on a board 20 which is arranged edgeways in the unit 2'. The electrodes in the sensor elements are arranged on the outer edge 20*a* of the board so that the ends of the electrodes 8 are in very close connection with, preferably exactly on the unit's transport surface 2*a'*.

The receiving and transmitting members 18, 19 in the rail of the yarn feeder are arranged on a board or the part 21, as is the winding 12 with associated iron core 12*a*. The winding 13 with associated iron core 13*a* is correspondingly mounted on or by the board 20. The transmitting and receiving members 16, 17 or 18, 19 consist of light emitting diodes and phototransistors. The diode 16 and the transistor 17 are arranged beneath a transparent covering part or a window 22 of glass and/or plastic material. The window 22 is arranged in connection with the yarn transporting surface 2*a'*. There are alternative embodiments of the transmitting members shown. Transmission can occur by inductive or capacitive means and alternatively superimposed on the generator function.

FIG. 2*b* shows the electrodes 8*a'*, 8*b'* and 8*c'* in an enlarged embodiment. The electrodes may be covered by a thin layer of wear-resistant material which does not conduct electricity, for example ceramics. The chosen thickness of the layer is less than 15μm, preferably approx. 4 μm.

Figure 3:
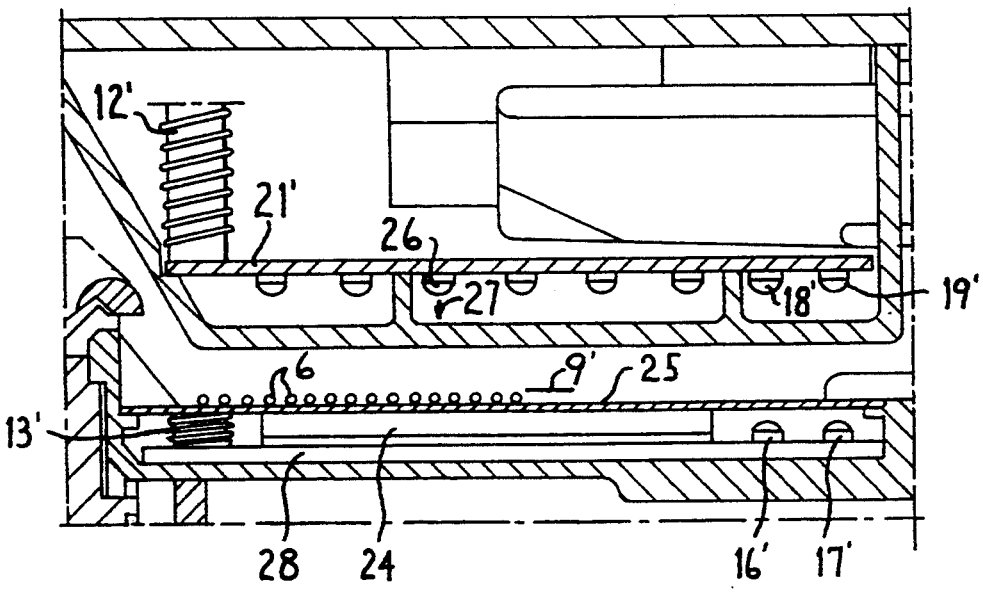
FIG. 3 shows an enlarged longitudinal sectional view of a second exemplary embodiment of the system.

FIG. 3 shows an optical embodiment of the sensing and/or analyzing system. In this case an extended sensor element 24 is used which may comprise integrated or discrete sensing detectors of a type known in the art (for example array). The sensor 24 is arranged under a plate 25 of transparent or translucent material which is moreover chosen so as to tolerate the wear from the yarn 6. The plate 25 is thereby arranged so that it forms the yarn transporting surface in accordance with the above. Energy is supplied correspondingly as in the embodiment according to FIG. 2*a*, i.e. by means of induction windings 12, 13. In this case, too, wirelessly functioning transmitting and receiving members 16', 17' and 18', 19' are included in accordance with the exemplary embodiment in FIG. 2*a*. In this case the plate 25 also extends over the transmitting and receiving members 16' and 17'. In this case the sensing and/or analyzing system operates with discrete radiation emitting sources 26, for example in the form of light emitting diodes. Illumination is therefore from above in the direction of the yarn stores indicated by the arrow 27. The plate 25 may therefore be of the type which comprises light apertures (not shown in particular) over which the yarn turns pass in succession. When each light aperture is covered by a yarn this provides an indication of the presence of the yarn turn and the aperture covered or shadowed by the yarn forms the basis for current indication. When the aperture is open this indicates that there are no yarn turns over the aperture, etc. The equipment 13', 16', 17', 24 and 25 is arranged on an assembly board 28 which runs at right angles to the plane of the figure according to FIG. 3.

The yarn feeder can comprise a microprocessor 29 located outside the spool body 2 (=main control unit or main microprocessor) (see FIG. 1) which is arranged on an assembly board 30 (FIG. 1) for evaluating the information obtained from the sensor elements. The wiring between the board equipment 21, 21' and the said microprocessor may be accomplished in a manner known in the art.

Figure 4:
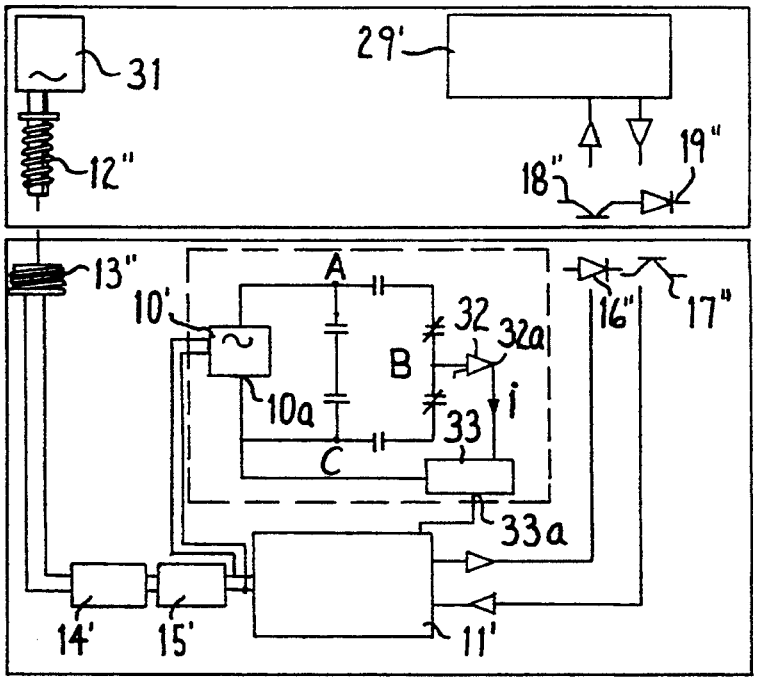
FIG. 4 shows a general diagram of the electrical assembly of the sensing and/or analyzing system.
Figure 5:
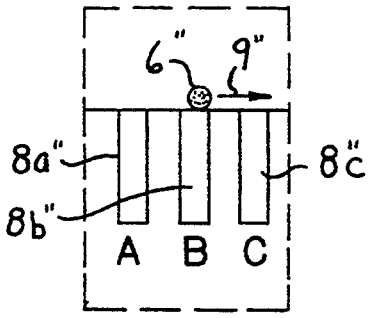
FIG. 5 shows an enlarged longitudinal sectional view of an alternative embodiment of the arrangement shown in FIG. 2*b*.

FIGS. 4, 5 and 6 show the indicating function for the embodiment according to FIGS. 1 and 2*a*. The parts corresponding to one another in the figures carry the same reference numerals but supplemented with primary and secondary symbols. An energy source, for example the general electrical mains, has been indicated by 31. The oscillator 10' constitutes a pulse frequency source and the electrodes 8*a'* and 8*c'* are supplied with electrical energy under the different pulses to their respective locations. The electrode 8*b''* (B) is connected to a differential amplifier 32. The oscillator 10' output 10*a* and the differential amplifier output 32*a* connected to a detector circuit 33 which in turn is connected to the microprocessor 11' via its output 33*a*. The detector circuit 33 senses the phase in the pulse source 10' and the output signal from the amplifier 32.

FIG. 6 shows by means of a voltage/time diagram how the passage of the yarn affects the capacitor voltage U as it passes over the electrodes 8*a'*, 8*b'* and 8*c'* and the points A, B and C. As the yarn 6''' (FIG. 15) is situated above the electrode 8*a''*, the voltage is high (point A) in order to then drop to zero (at point B) when it is in contact with the electrode 8*b''*. The voltage then increases with inverse amplitude as the yarn 6''' again comes into contact with the electrode 8*c''* (point C). The maximum values (absolute maximum values) therefore occur when the yarn is situated above the electrodes 8*a''* and 8*c''* (points A and C). The zero value (point B) is assumed when the yarn is above the electrode 8*b''*. The detector circuit 33 is designed to detect the said maximum values and zero value and to deliver information corresponding to the detection to the microprocessor 11'. The detector circuit may be of known type. Information in (fully or partially) processed form is transmitted via the transmitting member 16' to the receiving member 18' which in turn is connected to the microprocessor 29'. The latter can deliver information (for example control and/or supplementary information) via the transmitting member 19'' and receiving member 17'' to the microprocessor 11'in the unit/spool body.

Figure 2C:
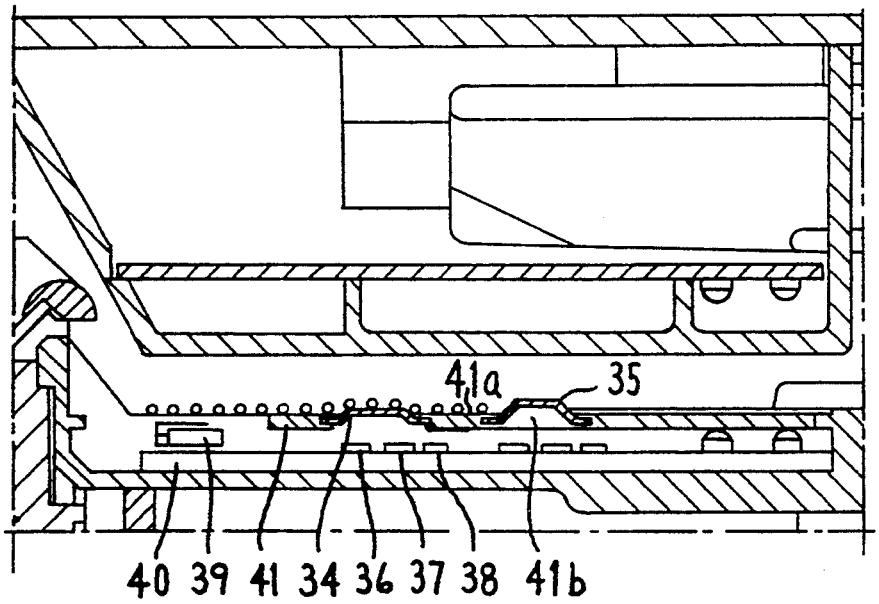
FIG. 2*c* shows an enlarged longitudinal sectional view of an arrangement which differs in relation to the design according to FIG. 2*a* in that members which cause modifications, for example through movement-/intrinsic movement, in capacitance on the basis of the yarn's travel is included together with an alternative embodiment of an energy source in the unit/spool body.

FIG. 2*c* shows an embodiment, modified in relation to the embodiment according to FIG. 2*a*, of a solution operating on the capacitive principle. In this case members 34, 35, of metal for example, are included which can change position in the radial direction of the spool body as a function of the yarn turns' travel over the yarn transporting surface of the unit. As the yarn turns pass, see the member 34, the member changes position, compare with the member 35 which is not affected by the yarn passage. This change in position (in a radial direction in the unit/spool body) of in this case the member 34 leads to a change in the capacitance in the "capacitor system" formed by the coverings/electrodes 36, 37, 38 and the member 34 itself, which change in capacitance thereby constitutes an indication that yarn turns exist above the member 34 (presses this down). Attention is also drawn in this exemplary embodiment to the fact that a battery 39, which is arranged on the board 40, may be used as an energy supply source. The members 34, 35 are arranged and controlled in a part 41 which with its upper surface 41*a* forms a part of the yarn transporting surface and which is provided with recesses 41*b* in which the members, which in the exemplary embodiment are bow-shaped, can change their height position through spring suspension or by means of return sprung radial movement.

In the following, exemplary embodiments will be described and the exemplary embodiments are considered from various starting points as regards the placing of the illumination in the spool body or in the rail of the yarn feeder, the type of sensing principle which may comprise contact image sensing, imaging by means of an object lens, shadow image sensing and reflection sensing. For the sake of clarity several of the figures show long beam paths which give large overall heights. Normally small overall heights are desirable which results in arrangements with reflecting beam paths, as shown in FIGS. 7, 8 and 12.

Figure 7A:
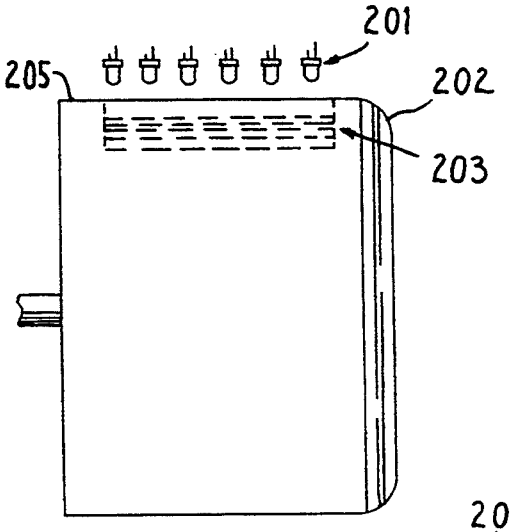
FIG. 7*a* shows a schematic side elevational view of a third embodiment which works with radiation source(s) outside the unit and radiation processing and detecting members in the unit, the members in the unit forming an assembled unit of low overall height.
Figure 7B:
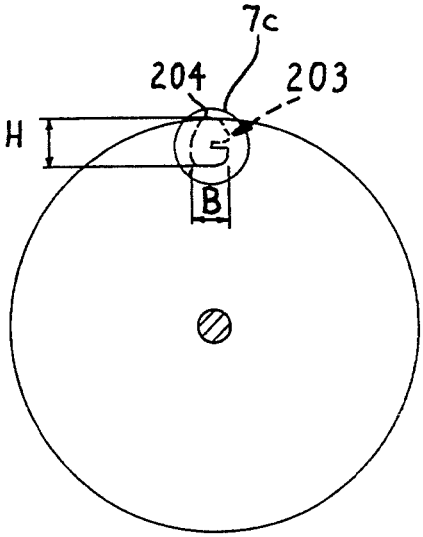
FIG. 7*b* shows a schematic front elevational view of the embodiment illustrated in FIG. 7*a*.
Figure 7C:
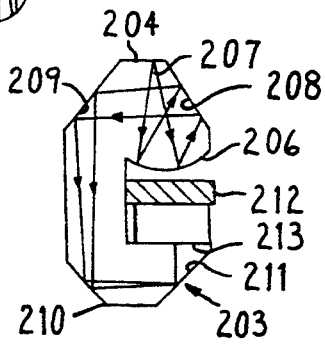
FIG. 7*c* shows an enlarged cross-section view of the area designated 7*c* in FIG. 7*b*, FIGS. 8*a*–8*b* show schematic side and front elevational views, respectively of a fourth embodiment which is a variant of the embodiment according to FIGS. 7*a*–7*c*, FIGS. 9*a*–9*b* show schematic side and front elevational views, respectively of a fifth embodiment which works with light emitting diode elements and elements with integrated sensor elements (array)

FIGS. 7*a*–7*c* show examples of imaging systems in which one or more radiation sources 201 are arranged outside the spool body 202 (for example in the rail of the yarn feeder) and radiation processing members (i.e. members which do not merely have a light guiding function) and sensor elements 203 down in the spool body. The latter members and elements are assembled in a common unit or imaging assembly 203 of low overall height H, and the assembly 203 is shown enlarged in FIG. 7*c*. The unit 203 is provided with a limiting surface 204 which forms or constitutes part of the yarn transporting surface 205 of the unit 202. The unit 203 has a spherical mirror 206 which is curved in the plane of FIG. 7*c* and straight in the plane of FIG. 7*a*. Alternatively another curved mirror can be used, for example parabolic, ellipse-shaped or another aspherical mirror, or a mirror of Fresnel type, etc. In a further embodiment it may also be curved in the plane of the latter figure. Incidental radiation 207 via the surface 204 is reflected by the concave surface of the mirror 206 against another surface 208 which in turn reflects the radiation against a third surface 209. Following further reflection against fourth and fifth surfaces 210 and 211, focused radiation against a sensor element 212 (for example array unit) is obtained whose sensing surface(s) is (are) arranged on a surface 213 under the mirror 206. By thus refracting or reflecting the radiation on a number of surfaces within an assembly unit the overall height H can be kept to a minimum. The measuring accuracy can be built in when manufacturing the body. The overall height may be approximately 1/10 of lthe spool body's diameter. The radiation source(s) may consist of or comprise discrete light emitting diodes (LED's) of known type. The width B of the unit 203 may also be assigned a small measurement and in the example shown is roughly the same as the height H. The system images a yarn turn under each discrete radiation source.

Figure 8A:
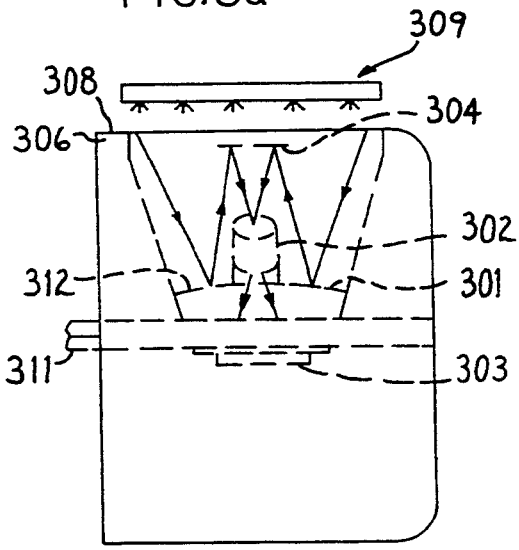
Figure 8B:
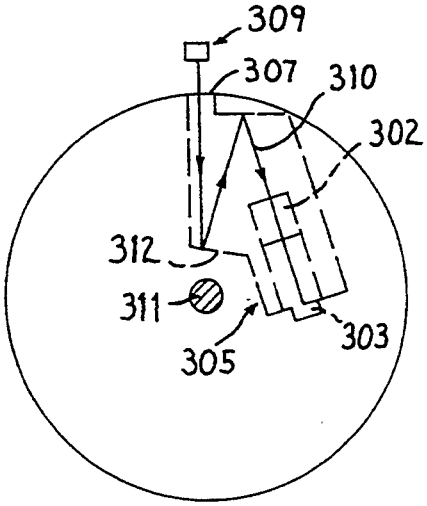

FIGS. 8*a* and 8*b* show a further example of imaging systems in which a spherical (for alternative forms see preceding paragraph) mirror 301, imaging optics 302 and sensor element (array unit) together with a reflecting surface 304 are assembled into a unit or imaging assembly 305 which can be fitted in the spool body 306, which has a defining surface 307 which coincides with or forms the unit's yarn transporting surface 308. The surface material on the surface 308 (and on the surface 204 in FIG. 7*c*) should, as well as being perviously arranged for the radiation, also form a non-slippery surface resistant to wear and tear from the yarn and may, for example, be made of any ceramic material, glass, plastic, etc. or material with scratch-resistant surface. A radiation emitting source 309 may herein consist of a panel whose outgoing radiation covers all or parts of the yarn store. The length of the panel may be 0.1 metre, for example. The arrangement in the unit 305 is thereby chosen so that conversion of the radiation path 310 can take place to the sensor element of a shorter length than the length of the panel 309. A standard embodiment of the array unit 303 can thereby be used. The arrangement is also constructed so that the unit 305 with parts can extend to the side of the shaft 311 of the unit. Radiation emitted from the source 309 passes the surface 307 and is reflected against the mirror 312, against its convex surface, which reflects the radiation obliquely back against the mirror 304. The latter reflects the radiation against the optics 302 which refract the radiation path against the array unit 303, which may be of the type which has 1024 sensing points, for example, through which the yarn store can be defined and followed.

Figure 9A:
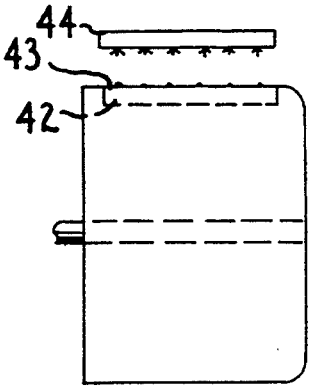
Figure 9B:
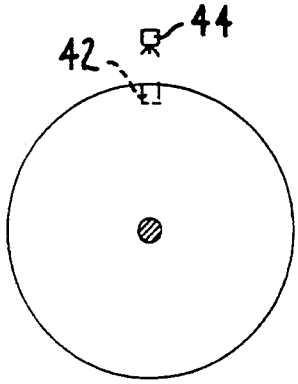

FIGS. 9*a* and 9*b* correspond to the principle shown in the exemplary embodiment according to FIG. 3 which constitutes a contact image principle. This principle uses an integrated sensor element (array) of a type known in the art which is situated on the yarn transporting surface. The sensor element in this case carries the reference numeral 42 and is arranged on the yarn transporting surface by means of a fibre glass/glass sheave 43. The sensor element/sensor elements is/are illuminated by a corresponding integrated light emitting unit (array) 44. A number of light emitting elements 44 and sensor element units 42 can be arranged in successive rows.

Figure 10A:
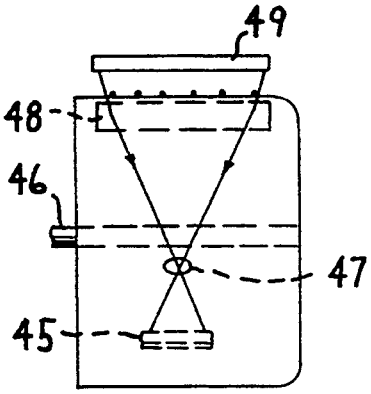
FIGS. 10*a*–10*b* show schematic side and front elevational views, respectively of a sixth embodiment which works with imaging optics.
Figure 10B:
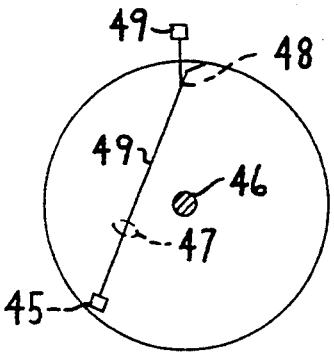

The exemplary embodiment according to FIGS. 10*a* and 10*b* shows a construction which works on the imaging principle. An array unit 45 is placed far down in the unit or spool body, the shaft of which is indicated by 46. An object lens is shown by 47 and a mirror arrangement by 48. The light emitting elements are located outside the spool body and are indicated by 49. The mirror arrangement 48 is used in order to prevent radiation paths 49 crossing the shaft 46. The unit 49 covers the width of the yarn store or can be arranged so that it covers this. Due to the position of the sensor element unit 45 far down in the unit a relatively short unit can be made to serve the longer unit 49. The unit 45 occurs in lengths of approx. 25 mm. The unit 49 has a length which is 2–3 times greater than the length of the unit 45. The unit 45 is located on the periphery of the body at a distance which is slightly less than the diameter of the body. Due to the long distance a good imaging function is obtained.

Figure 11A:
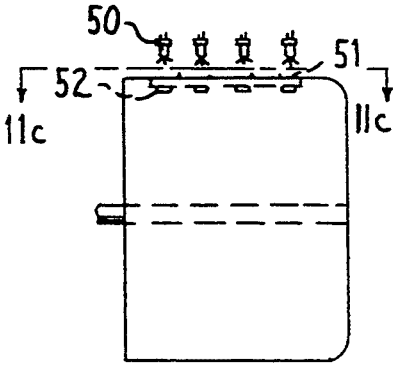
FIGS. 11*a*–11*b* show schematic side and front elevational views, respectively of a seventh embodiment.
Figure 11C:
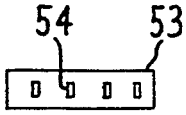
FIG. 11*c* shows a top plan view along the line 11*c*–11*c* of FIG. 11*a*, FIGS. 12*a*–12*b* show schematic side and front elevational views, respectively of an eighth embodiment.
Figure 11B:
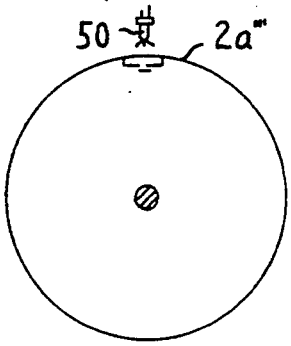

The embodiment according to FIGS. 11*a*–11*c* differs from the embodiment according to FIGS. 9*a* and 9*b* in that the light emitting elements consist of discrete light emitting diodes 50. A unit 51 with corresponding discrete sensor elements 52 is arranged in connection with the yarn transporting surface. The sensor elements are covered with a non-transparent plate 53 according to FIG. 11*c*. The plate is provided with a number of transparent apertures 54 or holes in front of the sensor elements. The plate may be curved in the view according to FIG. 11*b* so that it follows the yarn transporting surface 2*a*'''. This principle gives a shadow image of the gap on the detector. When identifying, the light through the gap is blocked entirely or partially by the yarn.

Figure 12A:
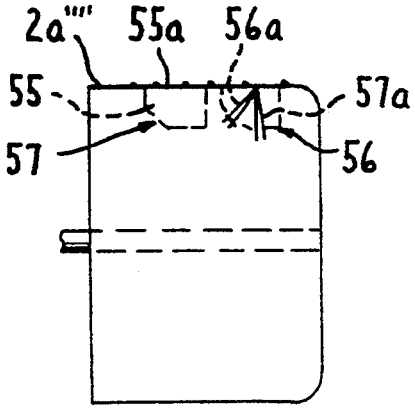
Figure 12B:
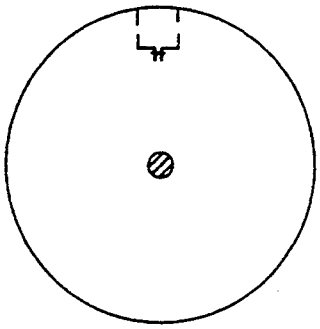

The embodiment according to FIGS. 12*a* and 12*b* shows the use of or imaging assembly, for example in the form of a moulded plastic body 55 which may be one or more in number. Each plastic body comprises one or more light or radiation emitting elements 56 and one or more sensor elements 57. Each component comprises a limiting surface 55*a* and the component/plastic body is preferably arranged in the unit in such a way that the limiting surface 55*a* coincides with the yarn transporting surface 2*a*''''. The element 56 and the element 57 are provided with focusing lenses 56*a* and 57*a*. The principle shown works with reflection of radiation emitted from the unit 56 against the yarn which reflects radiation to the element 57. The units 56 and 57 are arranged with their longitudinal axes at an angle in relation to one another and with the said focusing lenses so that the radiation is directed towards a specific point on the yarn transporting surface with the result that maximum radiation can be reflected by each yarn turn.

Figure 13A:
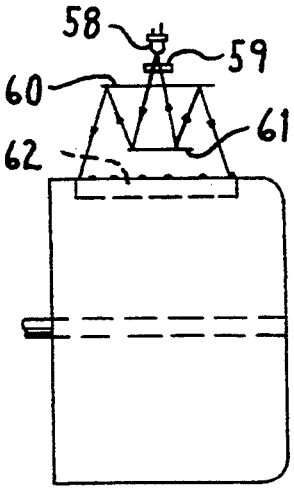
FIGS. 13*a*–13*b* show schematic side and front elevational views, respectively of a ninth embodiment.
Figure 13B:
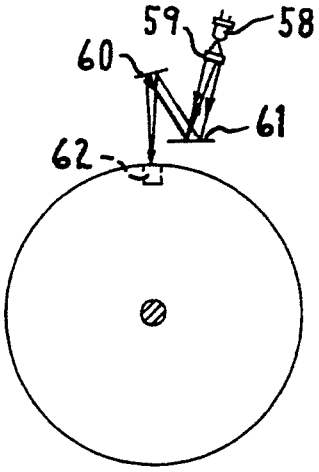

In FIGS. 13*a* and 13*b* contact or shadow image sensing is used. In this case a radiation source in the form of a semiconductor laser 58, LED unit, etc. is used. For converting the radiation to a line of suitable width a cylindrical lens 59 and a mirror arrangement with mirrors 60 and 61 are used. The radiation source, the lens and the mirrors are arranged outside the unit/spool body in which an integrated sensor element (array) is placed. The sensor element in this case carries the reference numeral 62. The lens 59 and the mirrors 60 and 61 are arranged so that the converted light covers desired, relatively large parts of the yarn store. The radiation path passes the cylindrical lens and is reflected against the mirror 61 back to the mirror 60, which in turn reflects the radiation against the unit 62. The radiation from the source 58 is chosen with a strength which ensures adequate illumination of the yarn store and the sensor element.

Figure 14A:
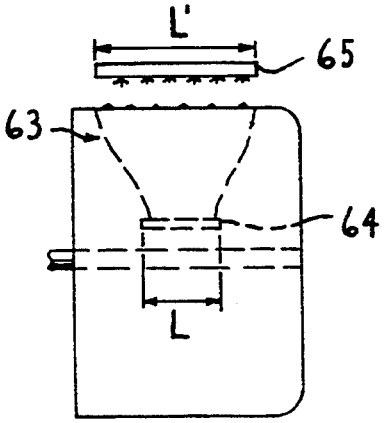
FIGS. 14*a*–14*b* show schematic side and front elevational views, respectively of a tenth embodiment.
Figure 14B:
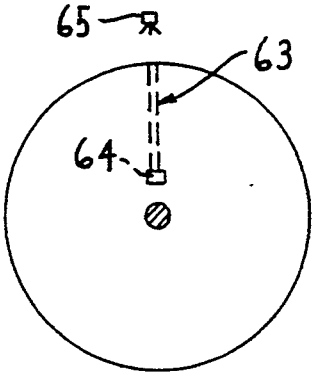
Figure 15A:
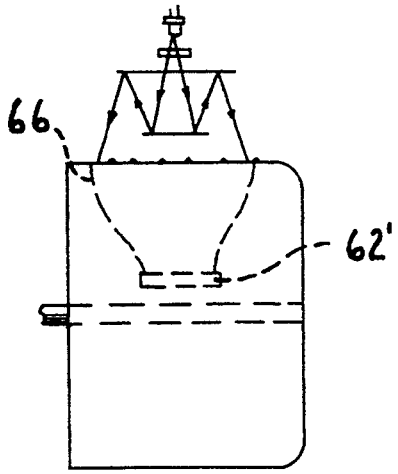
FIGS. 15*a*–15*b* show schematic side and front elevational views, respectively of an eleventh embodiment.
Figure 15B:
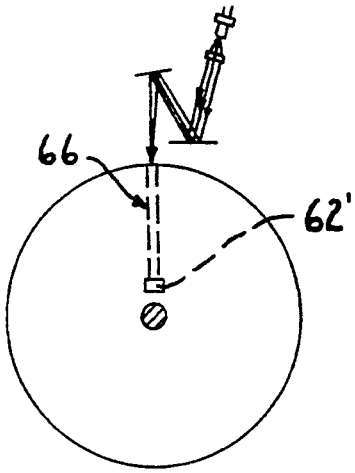

With the embodiment according to FIGS. 14*a* and 14*b* the integrated sensor element (array) has been moved down in the spool body with the aid of the use of fibre optic image guides 63. The advantage thereby is that a relatively short unit (array) 64 of length L can serve a relatively large yarn store and a relatively long radiation emitting unit 65, the length of which is indicated by L'. The latter length can be 2–3 times greater than the length L. FIGS. 15*a* and 15*b* are intended to show that corresponding downward movement of the element 62' in the body can be achieved with embodiments according to FIGS. 13*a* and 13*b*. The principle shown in FIGS. 15*a* and 15*b* is the contact image principle (i.e. fits close against and forms contact copy). Otherwise the embodiment functions like that shown in FIGS. 13*a* and 13*b*. In this case the fibre optic guides have been indicated by 66. The said guides 63, 66 may be arranged flexibly or fixed. It is also possible to arrange these guides so that the ends of the guide on some guides are radiation emitting and some, after reflection against each yarn turn part, are radiation receiving.

Figure 16A:
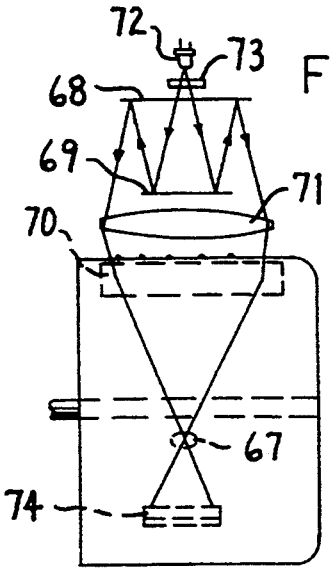
FIGS. 16*a*–16*b* show schematic side and front elevational views, respectively of a twelfth embodiment.
Figure 16B:
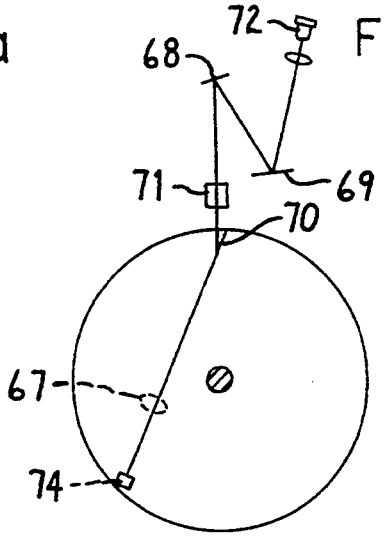

FIGS. 16*a* and 16*b* show an embodiment with imaging optics in which the object lens is labelled 67 and mirrors included in the system 68, 69 and 70. In this case a field lens/focusing lens 71 is also used. Also included are a laser diode 72 and a cylindrical lens 73. A CCD array has been indicated by 74. By means of the mirrors 68 and 69 the light from the laser diode 72 is reflected. With the mirror 70 the radiation path is deflected past the unit's centre (shaft). The field lens can in principle be arranged in the spool body. Alternatively field lenses can be arranged both outside and in the spool body. The focusing lens may be of the Presnel or HOE (=holographic optical element) type. Due to the long distance between the light emitting arrangement and the sensor unit 74, a good imaging function is obtained.

Figure 17A:
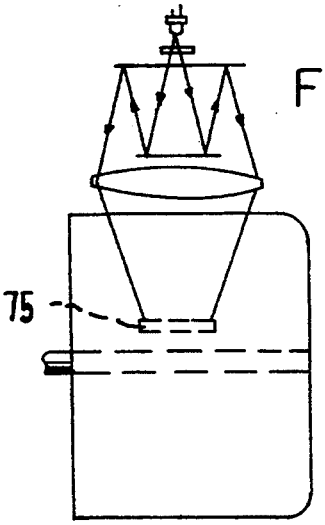
FIGS. 17*a*–17*b* show schematic side and front elevational views, respectively of a thirteenth embodiment.
Figure 17B:
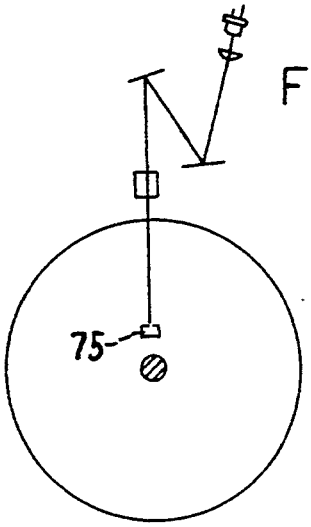

FIGS. 17*a* and 17*b* show a diode, mirror and field lens arrangement similar to that which appears in FIGS. 16*a* and 16*b*. In this case the imaging principle is not used without the shadow imaging principle. An array is arranged in the spool body and the field lens has an extent which means that the width of the yarn store can be acceptably covered.

Figure 18A:
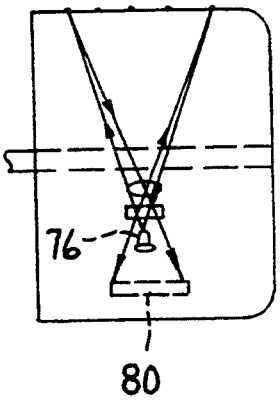
FIGS. 18*a*–18*b* show schematic side and front elevational views, respectively of a fourteenth embodiment.
Figure 18B:
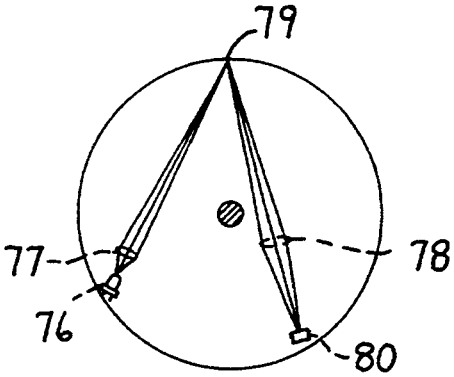

FIGS. 18*a* and 18*b* show the instance in which both the illumination source radiation source, for example in the form of a semiconductor laser 76, are arranged inside the spool body. A cylindrical lens 77 is arranged in connection with the laser. An object lens is shown by 78 and the locations of the different parts are such that the convergence point 79 is situated on the yarn transporting surface. In this case the sensor element is in the form of a CCD array. The lens 77 refracts the radiation from the source 76 to the line 79 and the sensor element obtains a well defined measuring point through the object lens 78. The arrangement is extremely accurate and is characterised by small measuring points. The parts of the system are also arranged so that the radiation path is led to the side of the centre shaft of the spool body.

With regard to capacitive indication of the yarn, this may depend upon a certain quality in the yarn (for example that it should comprise hydrocarbons, is static, etc.) unless the mechanical influence of the yarn is used by the indicating members.

FIGS. 19*a*–19*d* show an assembly which works on the diffraction principle. In this case a radiation source 80 (laser, LED, etc.) and a detector 81 with one or more blind spots 82, 82' are used. The detector may be in the form of an array unit 81' with a number of detector surfaces 81*a* or a single detector 81'' with a detector surface 81*b*. Also included in the arrangement are lens members 83, 84. Yarn stores travelling in the direction of the arrow 85 pass parallel radiation 87. If no yarn passes the radiation 87, all radiation is focused on each spot 82, 82'. If yarn passes the radiation the radiation is refracted or dispersed to the light sensitive surfaces 81*a* or 81*b*. In the case according to FIG. 19*c* with a laser as light source with several radiation sensitive surface parts 81*a* the diameter of the passing thread can be calculated from the radiation distribution over the detector array unit 81'.

Figure 19A:
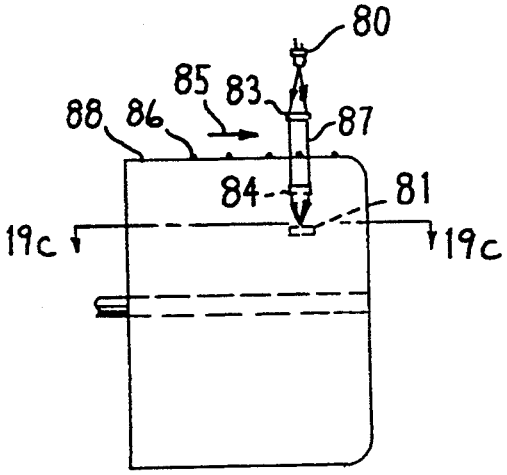
FIGS. 19*a*–19*b* show schematic side and front elevational views, respectively of an embodiment which operates on the diffraction principle.
Figure 19B:
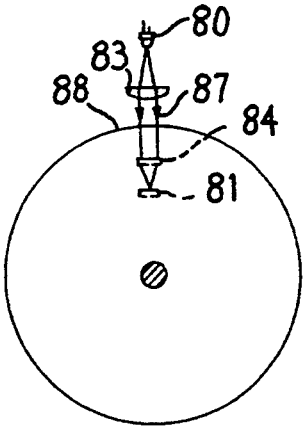
Figure 19C:
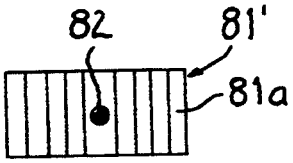
FIG. 19*c* shows a top plan view of detector arrangement along the line 19*c*–19*c* of FIG. 19*a*.
Figure 19D:
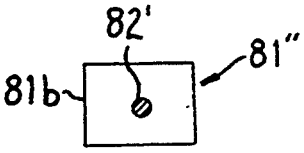
FIG. 19*d* shows a top plan view of an alternative embodiment of the detector arrangement shown in FIG. 19*c*, FIGS. 20*a*–20*b* show schematic side and front elevational views, respectively of an embodiment with spectral sensing.

The periodicities in the diffraction pattern are proportionally to the focal length of the receiving lens 84 divided by the diameter of the yarn/thread. For a focal length of 10 mm and approx. 100 μm periodicity, for example, the yarn diameter is in the order of 100 μm. Yarn with a smaller diameter gives clearer ("bigger") diffraction patterns on the detector 81' and vice versa. The principle shown is suitable for use as a take-off sensor. The blind spot can be made relatively accurately. If the yarn identification is largely insensitive to vibrations a blind spot size is used which can cope with the vibration in question. A plate, for example of glass, can be used to form the yarn transporting surface and the receiving lens can be moulded together with the plate and be included in the same unit as the detector 81. The lens 83 may have a larger range in the view according to FIG. 19*b* than in the view according to FIG. 19*a* so as to meet the said insensitivity to vibrations. The blind spot may consist of a dark surface or be situated at the side of the detector with the aid of mirror arrangements. A large surface for the radiation 87 can be used and the radiation's cross section can assume different forms (circular, square, etc.). The system with the source 80 and the detector 81 can be angled towards the transporting surface 88 or be at right angles to this as shown in FIG. 19*a*. The transmitting and detector arrangement may also be angled in relation to one another. A large lens 83 and a radiation source can be used together with two or more detectors of which some or all may be provided with their own blind spot. The principle gives relatively large signals when several threads are passing the radiation 87 at the same time. An apparently large measuring surface is obtained for each yarn turn as these move through the radiation 87. In the embodiment according to FIG. 19*d* an effective yarn presence detection is obtained. Detection is achieved in both the said exemplary embodiments regardless of whether the thread is on the spool body surface or appears, for example, in a "balloon" (for example as yarn is drawn off from the spool body) above this.

Figure 20A:
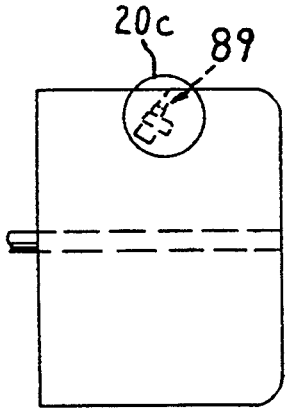
FIG. 20*c* shows an enlarged side elevational view of the area designated 20*c* in FIG. 20*a*.
Figure 20B:
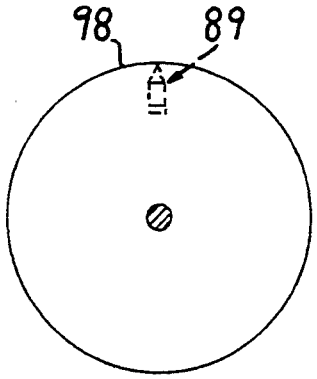
Figure 20C:
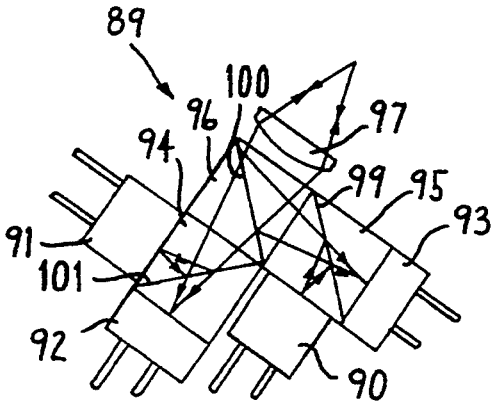

FIGS. 20*a*, 20*b* and 20*c* show an embodiment with spectral sensing and can be used for detecting colour shades. The energy content at different wavelengths in the radiation is measured and sensed/allocated. A unit 89 comprises two sources 90, 91 (LED's) which transmit different wavelengths λ1 and λ2. In addition are included two detectors 92, 93 and beam splitters 94, 95, 96, the latter of which 96 is spectrally selective, which partially reflects the radiation and partially allows the radiation through. A lens focuses radiation emitted from the unit against the thread transporting surface 98 and refracts radiation reflected from each thread to the unit.

The source 90 emits radiation which is reflected by surfaces 99, 100 against the thread in question via the lens 97. This radiation is reflected back to the detector 93. The radiation from the source 91 is reflected on the surface 101 and passes the surface 100 and reaches the thread via the lens 97. This radiation is reflected back through the surfaces 100 and 101 to the detector 92. By means of the ratio division of signals received on the detectors it is possible to determine whether or not the thread has a desired colour shade. Alternatively the radiation can be pulsed sequentially and out of phase from each radiation source. Using the assembly shown each yarn turn can be illuminated at the same point with the two radiation sources. Alternatively the two systems can be separated. Alternatively the beam sources may consist of lasers.

Figure 21A:
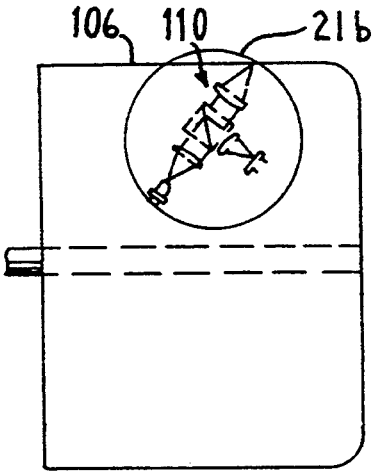
FIG. 21*a* shows a schematic side elevational view of an embodiment utilizing polarized light.
Figure 21B:
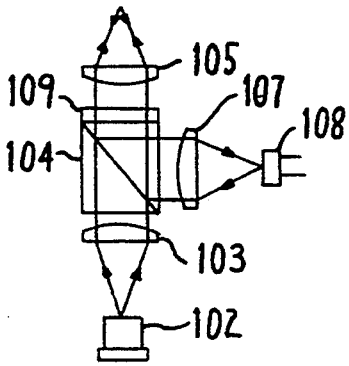
FIG. 21*b* shows an enlarged side elevational view of the area designated 21*b* in FIG. 21*a*, FIGS. 22*a*–22*b* show schematic side and front elevational views, respectively of an embodiment utilizing crossing polarization filters.

FIGS. 21*a* and 21*b* show an example with polarised light. A source (laser) 102 emits linear polarised light which is transmitted 100% through a lens 103, a beam splitter 104, a lens 105 to the transporting surface 106 where it is reflected on each passing yarn turn back to the lens 105 and the beam splitter 104, from where it is reflected via a lens 107 towards a detector 108. At the beam splitter 104 the radiation passes a plate 109 (λ/4—plate) twice, which means that the polarisation direction is turned through 90° in its path towards the detector 108. 100% of the radiation is reflected to the detector. The said parts form a unit 110 which has a relatively low demand on the power output by the source 102. It is assumed here that the yarn does not affect the polarization state too greatly, otherwise the effectiveness of the unit is reduced.

Figure 22A:
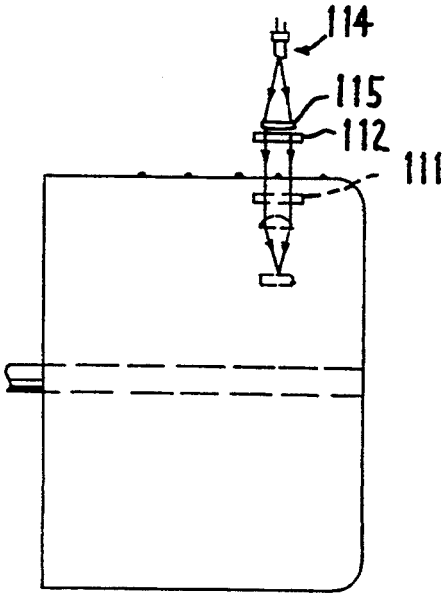
Figure 22B:
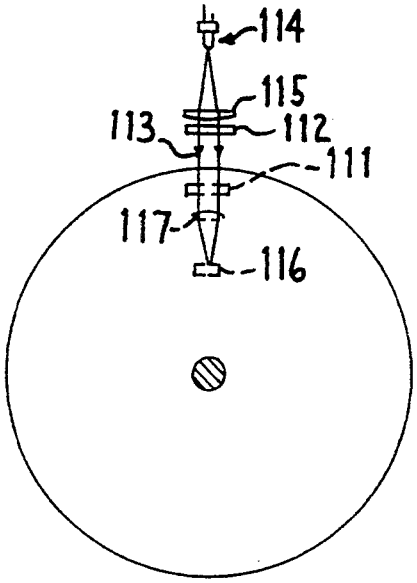

FIGS. 22*a* and 22*b* show an embodiment with two crossing polarization filters which extinguish the parallel radiation 113 which is obtained from a source 114 with associated lens 115. No radiation (apart from a certain DC level) reaches a detector 116 via a lens 117. The polarization state is interrupted by the passage of a thread and light can thereby pass to the detector 116 which in this way indicates the presence of each thread turn.

Figure 23:
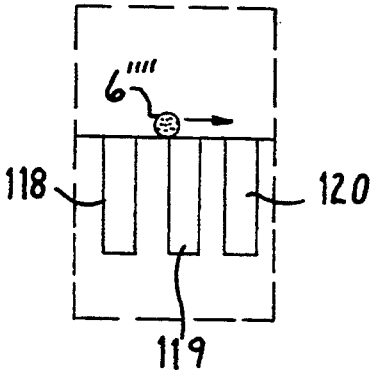
FIG. 23 shows an enlarged longitudinal sectional view of an alternative embodiment of the arrangement shown in FIG. 5.

FIG. 23 shows a further alternative embodiment of the invention in which the capacitively functioning elements 8*a*'', 8*b*'' and 8*c*'' etc., shown if FIG. 5, are replaced by a number (only three are shown here) of preferably identical, discrete sensor elements 118, 119, 120 of piezo-electric type, i.e. in which each discrete element consists of or comprises piezo-electric material which has the capacity to register the modification in pressure which occurs when a yarn turn 6'''' travelling forward on the spool body starts or stops pressing on the element in question as it passes each discrete element. An alternative embodiment of this type should also offer the facility of being able to detect the take-off of yarn from the spool body in the yarn feeder by simple means (directly on the spool body), i.e. to be used as a yarn take-off sensor. The signal processing which is chosen as a function of the desired type of detection, for example registering of the size of the yarn store, can thereby be designed to take place through sequential scanning of the signal from each piezo element in the entire series of successively arranged, preferably identical sensor elements, and by using signal processing electronics current in the piezo-electric sphere.

The present invention is not limited to the embodiments shown above merely as examples, but can be subjected to modifications within the framework of the following Patent Claims and the concept of the invention.

We claim:

1. A yarn feeding device comprising:

a stationary motor housing having an electric drive motor mounted therein, said motor driving a rotatable longitudinally extending hollow shaft;

a spool body rotatably supported by said hollow shaft and extending substantially coaxially from said housing, said spool body defining a peripheral, longitudinally extending yarn storage surface thereon;

means for holding said spool body stationary relative to said housing;

a rotatable winding member fixedly attached to said hollow shaft and positioned between said housing and said spool body, said winding member tangentially winding yarn fed axially through said hollow shaft onto said yarn storage surface at an end thereof adjacent said housing, and yarn being withdrawn from said yarn storage surface at an end thereof remote from said housing;

a rail fixedly secured to and extending longitudinally from said housing past said spool body and being radially spaced apart from said yarn storage surface; and a yarn sensing system including active sensor means positioned within said spool body for signalling the presence or absence of yarn in a yarn sensing area of said yarn storage surface, first wireless communication means located apart from said spool body for receiving signals indicative of the presence or absence of yarn in said yarn sensing area, second wireless communication means located within said spool body for communicating signals from said active sensor means to said first wireless communication means, circuit means for processing signals from said active sensor means, and means located within said spool body for supplying electrical input energy to at least said active sensor means and said second wireless transmission means.

2. The yarn feeding device claimed in claim 1, wherein said active sensor means includes a plurality of sensor elements arranged longitudinally along, and in close radial proximity to said yarn storage surface.

3. The yarn feeding device claimed in claim 2, wherein each of said sensor elements includes at least one capacitive electrode.

4. The yarn feeding device claimed in claim 2, wherein each of said sensor elements includes at least one opto-electric sensor element.

5. The yarn feeding device claimed in claim 2, wherein each of said sensor elements includes at least one piezo-electric sensor element.

6. The yarn feeding device claimed in claim 2, wherein each of said sensor elements includes at least one first capacitive electrode connected to means for generating high frequency signals, and at least one second capacitive electrode operating as an antenna, said first and second electrodes having dielectric constants which vary in accordance with the passage of yarn over said sensor element.

7. The yarn feeding device claimed in claim 6, wherein said active sensor means further includes a differential amplifier means for sensing a variation in said dielectric constants, said differential amplifier means including means for generating a signal indicative of a single yarn turn.

8. The yarn feeding device claimed in claim 1, further including a second circuit means mounted on said rail for processing data received from said yarn sensing system.

9. The yarn feeding device claimed in claim 1, wherein said circuit means is positioned within said spool body.

10. The yarn feeding device claimed in claim 9, wherein said circuit means includes a microprocessor connected to said active sensor means and said second communication means.

11. The yarn feeding device claimed in claim 1, wherein said circuit means is mounted on a circuit board, said active sensor means is mounted on a longitudinal edge of said circuit board, and said circuit board is oriented in said spool body so that said active sensor means is positioned proximate to said yarn storage surface.

12. The yarn feeding device claimed in claim 1, wherein said means for supplying electrical input energy includes a battery mounted in said spool body.

13. The yarn feeding device claimed in claim 1, wherein said means for supplying electrical input energy includes an inductive coil having a first winding member mounted to said rail and connected to a source of input power, and a second winding member mounted to said spool body, said first and second winding members being inductively coupled together, and said means for supplying electrical input energy further includes means for rectifying an output voltage from said second winding member, and means for filtering the rectified output voltage.

14. The yarn feeding device claimed in claim 1, wherein said means for supplying electrical input energy includes a generator having a first winding member fixedly mounted to said hollow shaft and a second winding member mounted to said spool body.

15. The yarn feeding device claimed in claim 1, wherein said first communication means includes first transmitter member and first receiver member mounted on said rail, and said second communication means includes second transmitter member and second receiver member mounted in said spool body.

16. The yarn feeding device claimed in claim 15, wherein said first and second communication means communicate by infra-red optical data transmission, and wherein said first and second transmitter members each include a light emitting diode, and said first and second receiver members each include a phototransistor.

17. The yarn feeding device claimed in claim 15, wherein said first and second communication means communicate by inductive data transmission.

18. The yarn feeding device claimed in claim 15, wherein said first and second communication means communicate by capacitive data transmission.

19. The yarn feeding device claimed in claim 1, wherein said yarn sensing system further includes at least one imaging assembly mounted within said spool body and having light source means for generating a light beam directed at said yarn sensing area, said active sensor means being responsive to said light beam which is reflected by yarn in said sensing area, said imaging assembly also having a plurality of focusing lens mounted along a path of travel for said light beam.

20. The yarn feeding device claimed in claim 1, wherein said yarn sensing system further includes light source means mounted on said rail for generating at least one light beam directed at said yarn sensing area, and said active sensor means being receptive to said light beam.

21. The yarn feeding device claimed in claim 20, wherein said light source means includes a plurality of discrete light beam generating members, and wherein said active sensor means includes a corresponding plurality of light sensor elements mounted in an integrated assembly, said assembly having a nontransparent surface positioned substantially coincident with said yarn storage surface and having transparent apertures therethrough which permit said light beams to pass to said light sensor elements.

22. The yarn feeding device claimed in claim 20, wherein said yarn sensing system further includes at least one imaging assembly mounted within said spool body, said imaging assembly having a surface which defines at least in part said yarn storage surface, and having at least one mirror which directs said light beam to said active sensor means by a plurality of intermediate reflecting surfaces.

23. The yarn feeding device claimed in claim 22, wherein said light source means includes a plurality of discrete light beam generating members, and wherein a height of said imaging assembly in a radial direction relative to said spool body is approximately one-tenth the diameter of said spool body and a width of said imaging assembly in a circumferential direction relative to said spool body is approximately equal to said height of said imaging assembly.

24. The yarn feeding device claimed in claim 20, wherein said light source means includes a plurality of discrete light beam generating members, and wherein said active sensor means includes an integrated sensor assembly and a translucent plate radially overlying said integrated sensor assembly and said second communication means, said translucent plate defining at least in part said yarn storage surface.

25. The yarn feeding device claimed in claim 20, wherein said active sensor means includes a sensor element mounted within said spool body proximate a peripheral side of said spool body remote from said yarn sensing area, a mirror assembly mounted proximate said yarn sensing area for directing said light beam away from a central axis of said spool body to said sensor element, and an optical lens mounted in line with a path of travel of said light beam, said light source means having an axial length approximately 2 to 3 times an axial length of said sensor element, said sensor element being mounted at a fixed distance away from said yarn sensing area which fixed distance is greater than a radius of said spool body and less than a diameter of said spool body.

26. The yarn feeding device claimed in claim 20, wherein said active sensor means includes an integrated sensor element spaced apart radially inwardly from said yarn sensing area, said light source means having an axial length approximately 2 to 3 times an axial length of said integrated sensor element, and said yarn sensing system further includes a fiber optic imaging guide mounted within said spool body and extending radially outwardly from said integrated sensor element to said yarn sensing area, a radially inner end of said imaging guide having an axial length equal to an axial length of said integrated sensor element, and a radially outer end of said imaging guide having an axial length equal to an axial length of said light source means.

* * * * *

UNITED STATES PATENT AND TRADEMARK OFFICE

CERTIFICATE OF CORRECTION

PATENT NO. : 5 377 922

DATED : January 3, 1995

INVENTOR(S) : Lars-Berno FREDRIKSSON, et al

It is certified that error appears in the above-indentified patent and that said Letters Patent is hereby corrected as shown below:

On the title page, item [22] change "Jun. 6, 1990" to ---Jun. 6, 1991---.

Column 19, line 30; after "said" (first occurrence) insert ---yarn---.

Signed and Sealed this

Ninth Day of May, 1995

Bruce Lehman

*Attest:*

BRUCE LEHMAN

*Attesting Officer*

*Commissioner of Patents and Trademarks*